US006695247B2

(12) United States Patent
Widlund

(10) Patent No.: US 6,695,247 B2
(45) Date of Patent: Feb. 24, 2004

(54) HOLDER FOR A PAPER ROLL WITH AXIAL DISPENSING OF THE PAPER IN THE ROLL

(75) Inventor: Urban Widlund, Pixbo (SE)

(73) Assignee: SCA Hygiene Products AB, Gothenburg (SE)

( * ) Notice: Subject to any disclaimer, the term of this patent is extended or adjusted under 35 U.S.C. 154(b) by 0 days.

(21) Appl. No.: 10/267,857

(22) Filed: Oct. 10, 2002

(65) Prior Publication Data

US 2003/0066924 A1 Apr. 10, 2003

Related U.S. Application Data

(60) Provisional application No. 60/327,789, filed on Oct. 10, 2001.

(51) Int. Cl.[7] ..... B65H 18/02

(52) U.S. Cl. ..... 242/593; 242/615.3; 206/409; 220/253

(58) Field of Search ..... 242/593, 132, 242/137, 146, 615.2, 615.3, 579, 580; 206/409, 390, 394, 205, 210, 812; 220/253; 221/63

(56) References Cited

U.S. PATENT DOCUMENTS 3,539,124 A * 11/1970 Belokin, Jr. ..... 242/597.7
4,524,895 A 6/1985 Lunden
5,215,211 A 6/1993 Eberle
5,577,634 A * 11/1996 Morand ..... 221/63
5,769,354 A 6/1998 Lindh et al.
5,996,930 A * 12/1999 Katayama et al. ..... 242/593
6,267,321 B1 7/2001 Tramontina

FOREIGN PATENT DOCUMENTS

EP 0 534 600 A2 3/1993
SE 502 603 11/1995

* cited by examiner

*Primary Examiner*—William A. Rivera
(74) *Attorney, Agent, or Firm*—Young & Thompson

(57) ABSTRACT

A holder for a paper roll with axial dispensing of the paper from the roll, includes a housing which has an end wall provided with a dispensing opening and tear elements extending around the periphery of the opening. The holder includes members for rotating the web of paper being drawn from a paper roll, which is disposed in the housing, relative to the paper roll in dependence of the length of paper web being drawn out of the dispensing opening, said members being disposed within the housing.

11 Claims, 4 Drawing Sheets

HOLDER FOR A PAPER ROLL WITH AXIAL DISPENSING OF THE PAPER IN THE ROLL

This application claims the benefit of provisional application No. 60/327,789, filed Oct. 10, 2001.

TECHNICAL FIELD

The present invention relates to a holder for a paper roll with axial dispensing of the paper from the roll, said holder comprising a housing which has an end wall provided with a dispensing opening.

BACKGROUND OF THE INVENTION

A holder for a paper roll with central dispensing of the paper from the interior of the roll is known from EP-A1-0 091 411. With such a dispensing the paper web axially drawn from the paper roll forms a spiral coil with axially displaced windings. This means in the first place that when drawing paper from a full roll, several layers of paper must be torn of with the aid of the tear means, the tearing force required could then being larger than the force required to axially draw paper from the paper roll, whereby it would be impossible for a user to tear off a desired length of paper web with the use of one hand only. In the second place the length of the paper web in the spiral coil being axially drawn from the paper roll is hard to determine for the user. Furthermore, the length of paper web must in most cases be uncoiled before use.

The object of the present invention is to eliminate these problems by providing a holder for a paper roll with axial dispensing of the paper from the roll which will enable the user to always be able to tear off a length of paper web being axially drawn from the paper roll with one hand only and which will facilitate the determination of the length of paper web being axially drawn from the paper roll and which will deliver the paper web wholly or to a large extent uncoiled.

SUMMARY OF THE INVENTION

This object is according to the invention accomplished by a holder for a paper roll with axial dispensing of the paper from the roll, said holder comprising a housing which has an end wall provided with a dispensing opening and tear means extending around the periphery of the opening, characterised in that the holder includes means for rotating the web of paper being drawn from a paper roll, which is disposed in the housing, relative to the paper roll in dependence of the length of paper web being drawn out of the dispensing opening, said means being disposed within the housing. Thereby the spiral coil of paper web axially leaving the paper roll when a length of paper web is drawn out of the dispensing opening in the housing, can be uncoiled so that a planar length of paper web will be dispensed from the dispensing opening.

In the preferred embodiment the means for rotating the web of paper being drawn from a paper roll being disposed in the housing relative to the paper roll comprises a pair of elongate, rotatable rollers disposed so that the nip between said rollers can frictionally hold a paper web drawn from a paper roll disposed in the housing, the length of paper web being drawn out of the dispensing opening determining the amount of rotation of said rollers and a device for rotating the paper roll, said device having drive means driven by one of the rollers holding a paper web being drawn out of the dispensing opening. Furthermore, the means for rotating the web of paper being drawn from a paper roll, which is disposed in the housing, relative to the paper roll, comprises a device for sensing the change in thickness of a paper roll disposed in the housing due to a length of a web of paper being drawn out of the dispensing opening and means for varying the rotational speed of the paper web relative to the paper roll in dependence of the change in thickness of the paper roll. Said means for varying the rotational speed of the paper roll can comprise an axially movable conical wheel being driven by a drive wheel axially extending from one of the rollers and being affixed to one end of a shaft being rotatably supported in the housing and extending in a direction parallel to the axis of a paper roll disposed in the housing, the other end of the shaft being connected to a device for axially moving the conical wheel in dependence of the thickness of the paper roll. Drive means for rotating a paper roll disposed in the housing is attached to the shaft between the ends thereof and comprises a drive roller acting on the peripherical surface of the paper roll. The holder preferably includes an annular disc for supporting a paper roll, said disc being rotatably supported in the housing.

Alternatively, the drive means for rotating a paper roll disposed in the housing comprises a drive wheel acting on the peripherical surface of the annular disc supporting the paper roll.

In a further embodiment, the drive means for rotating a paper roll disposed in the housing comprise an electric motor controlled by a computer to which a signal representative of the rotation of the rollers is fed.

BRIEF DESCRIPTION OF THE DRAWING

The invention will now be described with reference to the enclosed figures, of which.

DESCRIPTION OF EMBODIMENTS

Figure 1:
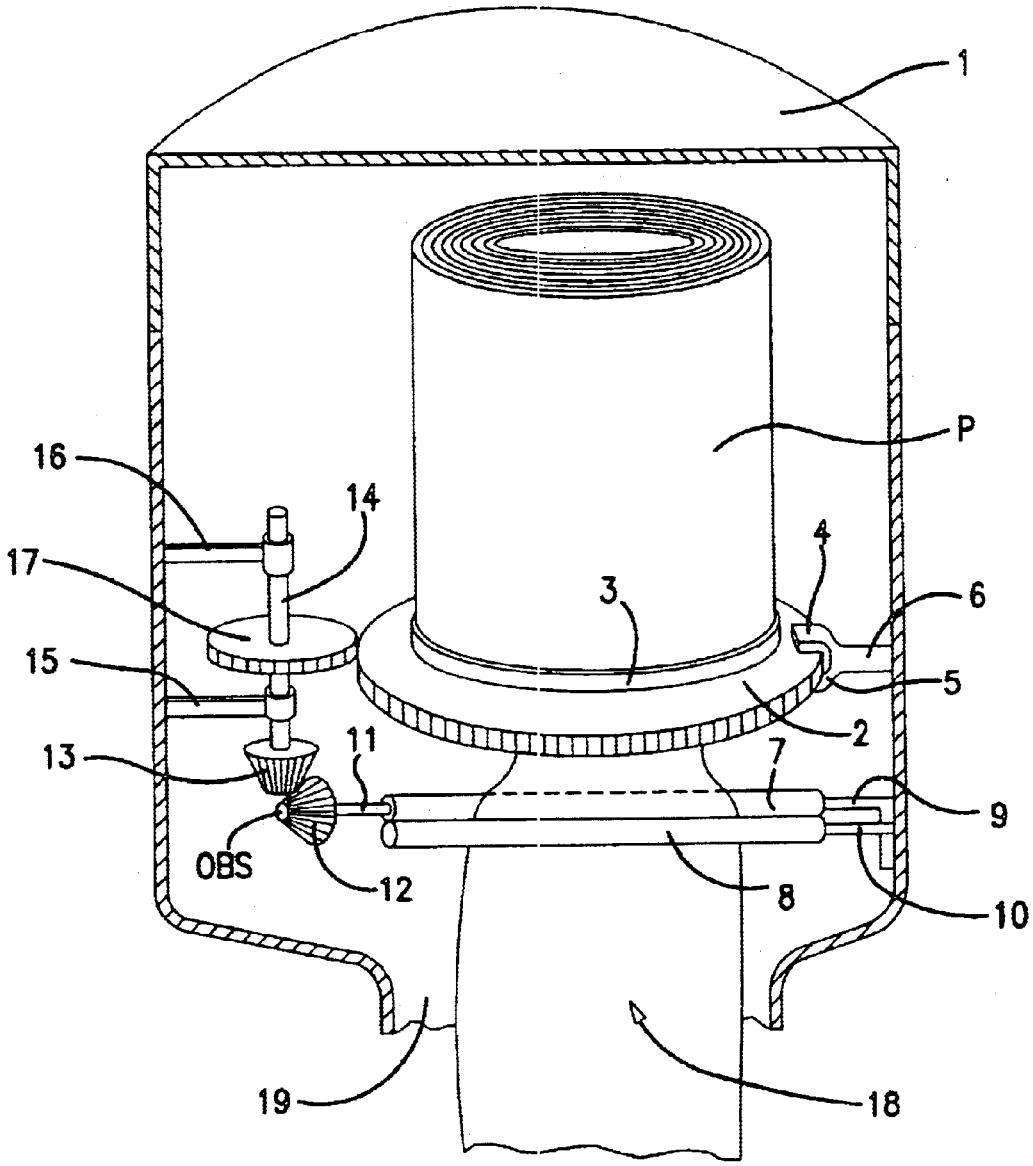
FIG. 1 schematically shows a perspective view of a holder for a paper roll according to a first preferred embodiment of the invention, FIG. 2 schematically shows a perspective view of a holder for a paper roll according to a second embodiment of the invention.

In FIG. 1, a first embodiment of a holder for a paper roll P is shown in a schematic perspective view, with a part of a housing 1 being taken away. The roll P is supported on an annular disc 2 having an inner diameter slightly smaller than the outer diameter of the paper roll P. The disc 2 also includes an annular flange 3 having an inner diameter corresponding to the outer diameter of the roll P. The disc 2 is rotatably supported in the housing 1 by any suitable means, such as between the prongs 4,5 of at least three forked rods 6 radially protruding from the inner wall if the housing 1 and evenly distributed around the periphery of the disc 2. Only one of the forked rods 6 are shown in FIG. 1. At least the inner surfaces of the prongs 5 being lowest in the figure could be provided with friction reducing means, such as freely rotating rollers or the like. The outer peripherical surface of disc 2 is geared.

The paper roll P is of the type in which paper is drawn from the interior of the roll. The holder shown in FIG. 1 is provided with a pair of elongate, hollow rollers 7,8 running parallel to each other in a transverse direction relative to axial direction of the roll P across the width of the roll P, the nip between the rollers 7,8 running through the prolongation of the axis of the paper roll P. The rollers 7,8 are rotatably supported in the housing 1 by any suitable means, such as shafts 9,10 fixed to the wall of the housing 1 and rotatably connected to the inner surface of the hollow rollers 7,8 by suitable bearings. The nip between the rollers 7,8 is dimensioned so that a paper web drawn from the roll P will be frictionally held by the rollers 7,8.

A shaft 11 to the free end of which a bevel gear wheel 12 is affixed, is protruding from the free end of roller 7. The shaft 11 is rigidly affixed to the roller 7. A bevel gear 13 with its axis running parallel to the axis of the paper roll P is geared to the gear wheel 12. The bevel gear 13 is rigidly affixed to the end of a shaft 14 which is rotatably supported by the housing by any suitable means, such as rods 15,16 affixed to the inner wall of the housing 1, the free ends thereof supporting holders for rotatably holding the shaft 14. At the level of the disc 2, a gear 17 being geared to the disc 2 is rigidly affixed to the shaft 14.

The housing 1 has also a dispensing opening 18 provided with tear means 19 around its periphery.

The holder functions in the following way.

When a user draws a length of paper web from the roll P out of the dispensing opening 18 the rollers 7,8 will be set in rotation. The rotation of the rollers will be dependent on the length of paper web being drawn out of the opening 18 and on the rate by which the paper is drawn out by the user. The gear wheel 12 will be rotated together with the roller 7 and the rotational movement of the wheel 12 will be transmitted to the disc 2 via the gears 13 and 17 and thereby to the paper roll P. This will lead to an uncoiling of the windings of the paper web being drawn out of the dispensing opening. In the embodiment disclosed in FIG. 1, the gear ratio of the gear mechanism described is constant, which means that the extent of uncoiling of the windings will vary with the inner diameter of the roll, a certain length of paper web will constitute several windings in the innermost part of the paper roll P whereas the same length of paper web will constitute only a portion of a winding in the outermost part of the roll. The gear ratio is chosen so that the rotation rate of the roll P will be smaller than needed for fully uncoiling the windings in the innermost part of the roll and larger than needed for uncoiling a winding in the outermost part of the roll. However, the gear ratio is also chosen so that the rotation rate of the paper roll correspond to the uncoiling of a winding before half of the thickness of the roll has been dispensed.

When the user stops the downward movement of the paper web the web will be frictionally held between the rollers 7,8 which ensures that the paper web can be torn against the tear means 19 without risk for the tearing force being greater than the frictional force holding the paper web in the nip between the rollers 7,8.

Figure 2:
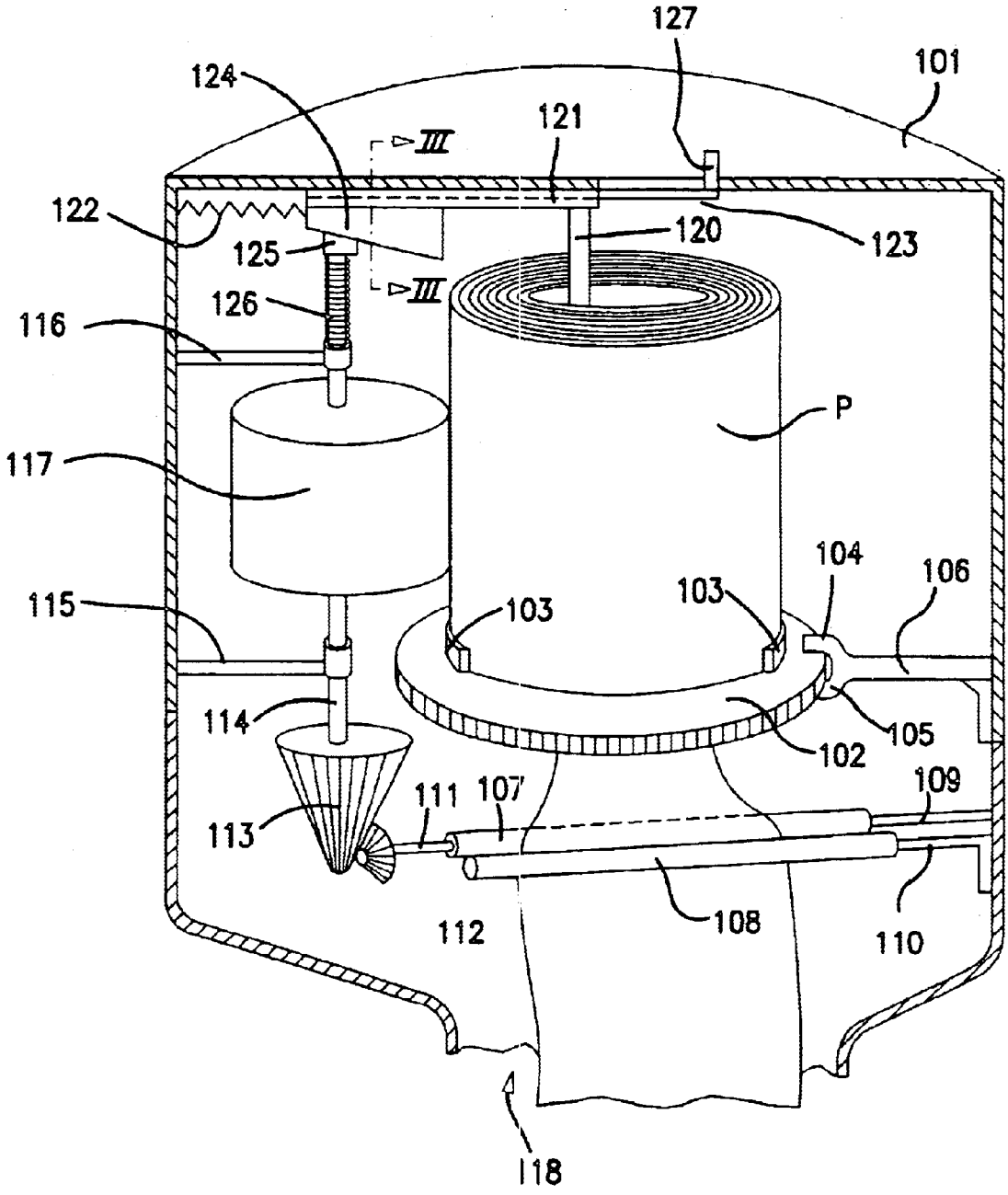

In FIG. 2 a second preferred embodiment of a holder according to the present invention is schematically disclosed in a view similar to FIG. 1. Similar to the embodiment of FIG. 1, a paper roll P of the type in which paper is drawn from the interior of the roll is supported in a housing 101 on an annular disc 102 and held in place by upwardly protruding ribs 103 evenly distributed around the circumference of a paper roll P supported on the disc 102. The disc 102 is, similarly to the disc 2 in FIG. 1, rotatably supported by the housing 101 via the prongs 104,105 of fork-shaped rods 106 distributed around the periphery of the disc 102. The holder 101 shown in FIG. 2 is in the same way as the holder 1 in FIG. 1 provided with a pair of elongate, hollow rollers 107,108 running parallel to each other in a transverse direction relative to axial direction of the roll P across the width of the roll P, the nip between the rollers 107,108 running through the prolongation of the axis of the paper roll P. The rollers 107,108 are rotatably supported in the housing 101 by any suitable means, such as shafts 109,110 fixed to the wall of the housing 101 and rotatably connected to the inner surface of the hollow rollers 107,108 by suitable bearings. The nip between the rollers 107,108 is dimensioned so that a paper web drawn from the roll P will be frictionally held by the rollers.

A shaft 111 to the free end of which a bevel gear wheel 112 is affixed, is protruding from the free end of roller 107. The shaft 111 is slidingly connected to the roller 107, for example by a splined coupling, and biased towards a conical gear 113 by any suitable means, such as an helical spring, the axis of the gear 113 running parallel to the axis of the paper roll P. The wheel 113 is thus always geared to the gear wheel 112. The conical gear 113 is rigidly affixed to the end of a shaft 114 which is rotatably supported by the housing by any suitable means, such as rods 115,116 affixed to the inner wall of the housing 101, the free ends thereof supporting holders for holding the shaft 114 in such a way that it can rotate and axially slide. Between the rods 115,116 a roller 117 is slidingly affixed to the shaft 114. The periphery surface of the roller 117 is coated with a friction increasing material, for example rubber or plastic foam, and this surface is in contact with the periphery surface of the paper roll P. Thus, the drawing out of a length of paper web from the roll P out of the dispensing opening 118 will lead to a rotation of the rollers 107,108 and a rotation of the paper roll in the same way as for the embodiment of FIG. 1.

Figure 3:
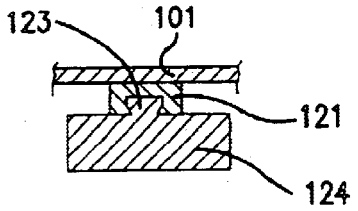
FIG. 3 shows a sectional view taken along the line III—III in FIG. 2, FIG. 4 schematically shows a perspective view of a holder for a paper roll according to a third embodiment of the invention.

In contrary to the embodiment of FIG. 1, the embodiment of FIG. 2 includes a device for sensing the change of inner diameter of the paper roll P and varying the rotation rate in dependence of the thickness of the roll. This device comprises a pin 120 which is supported in the roof of the housing 101 and which reaches into the centre hole of the paper roll P. A slide 121 affixed to the housing 101 enables the pin 120 to move in a transverse direction relative to the paper roll P. The pin 120 is biased by a spring 122 to move in a radial direction from the centre of the roll P towards the periphery thereof. Thus, during the dispensing of a paper web drawn out of the dispensing opening 118, the pin 120 will move to the left in FIG. 2 as the inner diameter of the paper roll increases. The pin 120 comprises a rib 123 having a complementary shape to a groove in the slide 121, as can be seen in FIG. 3. The device for sensing the inner diameter of the paper roll P and varying the rotation rate in dependence of the thickness of the roll comprises further a wedge-shaped member 124 affixed to the rib 123. The inclined surface of this member 124 is in abutment with an element 125, which is rotatably attached to the upper end of the shaft 114. A helical spring 126 disposed between the rod 116 and the element 125, biases element 125 and thereby the shaft 114 to abutment with the wedge-shaped member 124. When the member 124 is moved to the left in FIG. 2 due to an increase of the inner diameter of the roll P, the shaft 114 will be pushed axially downward. Thereby, the conical gear 113 will also be moved downward pushing the wheel 112 to the right against its biasing force. This means that a part of the conical gear 113 having a larger diameter than before will be geared to the wheel 112, the gear ration then being reduced so that the roller 117 will be driven with a smaller rotational speed. By chosing the conicity of the gear 113 and the inclination of the wedge-shaped member in a suitable way, it is possible to vary the rotational speed of the roller 117 so that the rotational speed of the paper roll P will always correspond to the uncoiling of the winding, windings or part of a winding that corresponds to the length of paper web being drawn out of the dispensing opening 118.

In the embodiment shown in FIG. 2, the rib 123 is prolonged beyond the pin 120 and carries an upwardly projecting pin 127. The pin 127 runs in an elongate opening in the roof of the housing 101 and projects out from the upper side of this roof to be accessible for a user. This facilitates a movement of the sensing pin 120 to the position shown in FIG. 2 before a new paper roll P is placed in the housing 101 in exchange for a used up paper roll.

Figure 4:
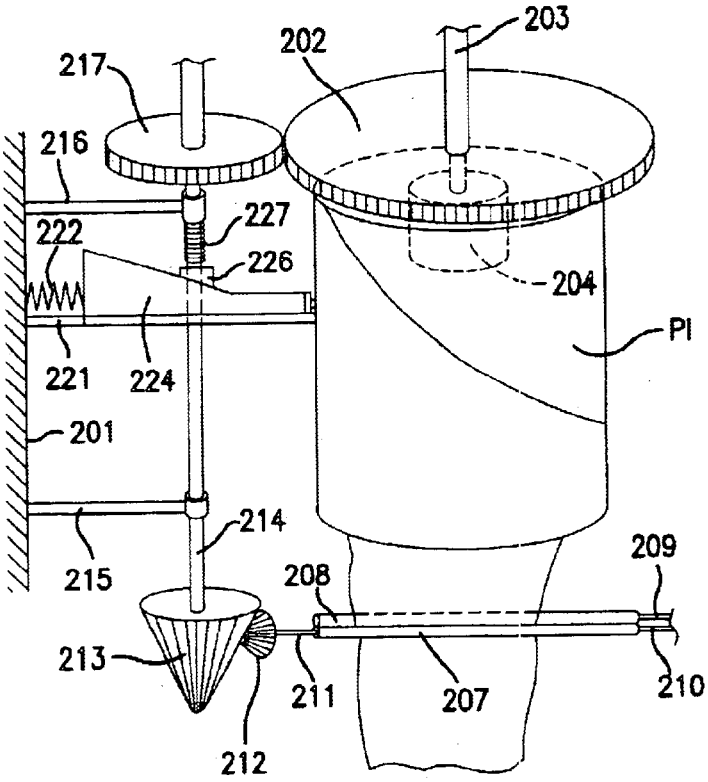
Figure 5:
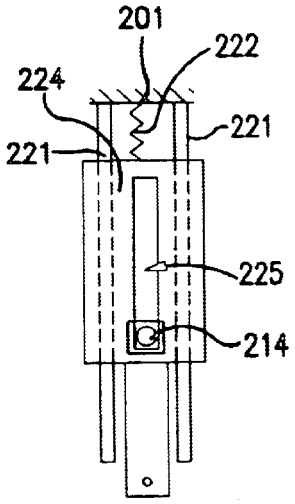
FIG. 5 shows a plan view of a wedge-shaped element being part of the device for vary the speed of the paper roll in dependence of the thickness thereof in the embodiment shown in FIG. 4.

In FIG. 4 a third embodiment of a holder for a paper roll PI is schematically shown in a view similar to FIGS. 1 and 2. The paper roll PI differs from the roll P in the embodiments according to FIGS. 1 and 2 in that the paper web is dispensed axially downward from the outer periphery of the roll instead of from the interior of the roll as is the case for roll P. The paper roll PI is frictionally held by a tubular body 204 which is fixed to a shaft 203. The shaft 203 is rotatably supported in the roof (not shown) of a housing 201. The tubular body 204 fits into the tubular central space of the roll PI and has preferably a resilient outer part, for example made of plastic foam. Similarly to the embodiments in FIGS. 1 and 2, the paper web axially drawn from the roll PI passes between the nip of two rollers 207,208 rotatably supported by rods 209,210 affixed to the housing 201. In a way similar to the embodiment in FIG. 2 a shaft 211 supporting a gear wheel 212 is slidingly attached to the roller 207 and biased to the left in FIG. 4 to bring the wheel 212 in abutment against a conical gear 213. The gear 213 is rigidly affixed to a shaft 214 supported by holders in the free ends of two rods 215,216 affixed to the housing 201. The shaft 214 can rotate and axially slide in relation to the holders of the rods 215,216. The upper portion of shaft 214 is slidingly attached to a gear 217 by any suitable means, such as a splined coupling. The gear 217 is geared to geared disc 202 which is affixed to the shaft 203 supporting the tubular body 204. The drawing of a length of paper web out of the housing will thus lead to a rotation of the paper roll PI by means of the rollers 207,208, the gears 212,213 and 217,202.

Similarly to the embodiment of FIG. 2, the embodiment shown in FIG. 4 also includes a device for sensing the change of diameter of the paper roll P and varying the rotation rate in dependence of the thickness of the roll. In this case it is the outer diameter that will vary in dependence of the amount of paper web dispensed from the roll PI. In this case a wedge-shaped member 224 is biased by a spring 222 to move to the right in FIG. 4 as the outer diameter of the roll PI decreases due to the dispensing of paper web therefrom. This element 224 is slidingly supported on two rods 221 affixed to the housing 201 and comprises an elongate opening 225 for the passage of the shaft 214. The upper inclined surface of the wedge-shaped member 224 is in sliding contact with an element 226 which is rotatably attached to the shaft 214 a biased by a spring 227 to move the conical gear 213 downwards. When the outer diameter of the roll PI decreases due to dispensing of paper web, the gear 213 will be moved upwards and a portion thereof having a smaller diameter than before will be in gear with the wheel 212. Thereby the rotation rate of the paper roll PI will increase as the outer diameter thereof decreases.

Figure 6:
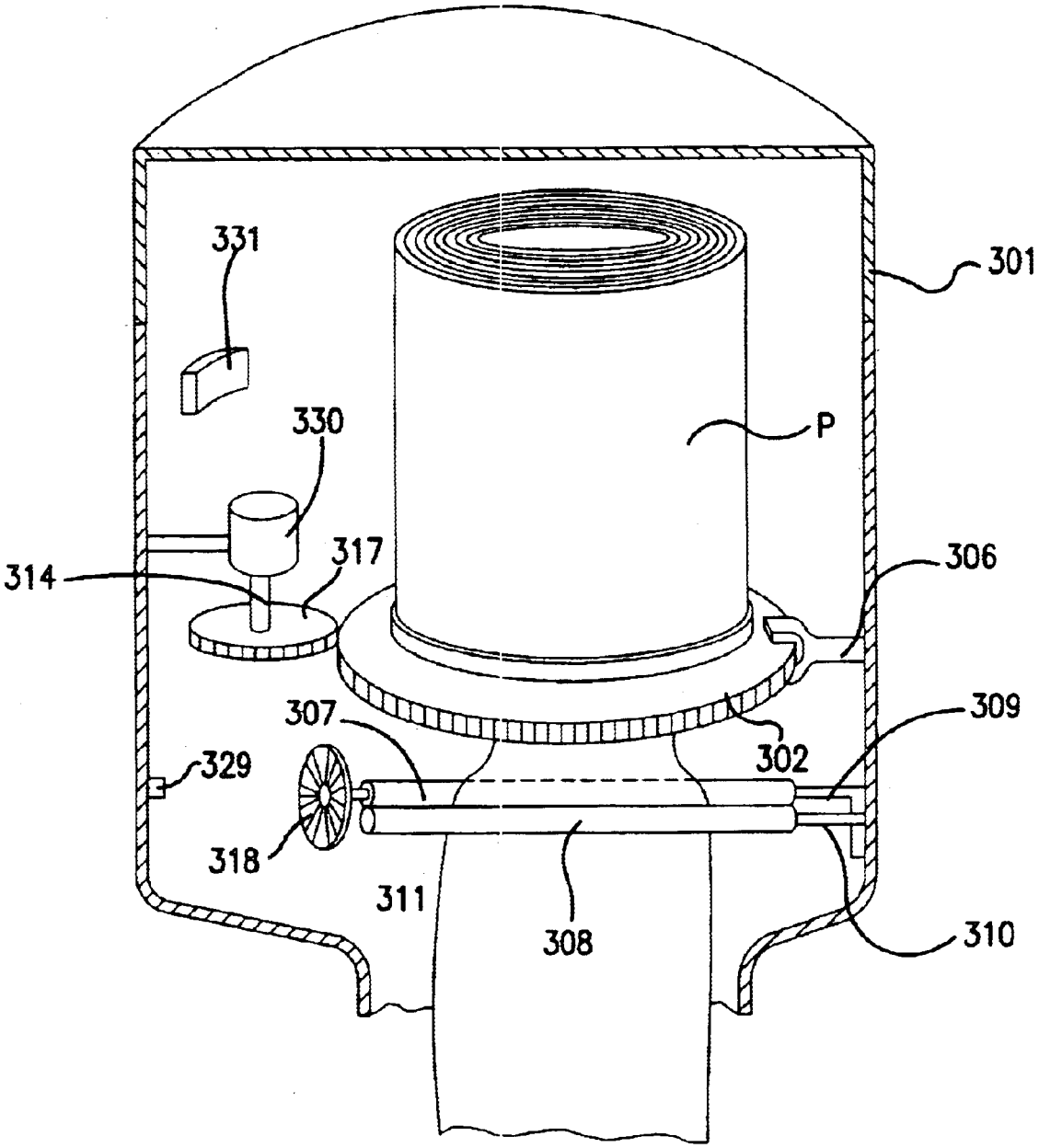
FIG. 6 shows a perspective view of a holder for a paper roll according to a fourth embodiment of the invention.

In FIG. 6 a fourth embodiment of the invention is schematically shown. In this embodiment, a disc 302 supporting a paper roll P from the interior of which paper web is axially drawn, is geared to gear 317 affixed to a shaft 314 driven by an electric motor 330, for example a step motor. The paper web drawn from the roll P passes the nip between rollers 307,308 in the same way as in the embodiments described above. A disc 328 affixed to a shaft 311 rigidly affixed to the roller 307 comprises radial lines around the circumference thereof. An optical reader 329 registers the rotational movement of the disc 328 by counting the lines and delivers a signal to a computer 331 representative of the amount of revolutions of the disc 328 and the rotation rate of the disc. Thereby the length of paper web drawn from the paper roll P can be calculated by the computer 331. Furthermore, the computer can also be programmed to calculate the number of windings that correspond to the length of paper web being drawn out of the roll P, these calculations being quite easy if the inner and outer diameter as well as the thickness of the paper web is known. Given these data the computer can easily be programmed to vary the rotation rate of the roll P in dependence of the increase of the inner diameter of the roll. The housing 301 preferably also comprises a rechargeable battery for supplying power to the motor 330, the computer 331 and the optical sensor 329.

In the embodiments described components having similar function has been given the same reference numbers as in FIG. 1 with the addition of 100, 200 and 300, respectively for the different embodiments.

From the foregoing it is evident that by "the thickness of the paper roll" is meant the difference between the outer and inner diameters of the roll P,PI.

The embodiments described above can of course be modified within the scope of the present invention. For example can the embodiment of FIG. 2 have a gear for driving the disc supporting the paper roll as in the embodiment of FIG. 1 instead of the friction roller directly driving the paper roll. The optical sensor in the embodiment according to FIG. 6 can be replaced by any suitable sensor for sensing the rotation of the rollers between which the paper web is frictionally held. It is also possible to rotate the rollers between which the paper web is frictionally held instead of the paper roll in order to uncoil the windings of the coil of paper web being drawn from the roll. Furthermore, the web of paper can have tear indications, for example perforations, in which case the tear means in the housing can be deleted. The housing need not be a casing enclosing the paper roll but can be a frame supporting the means for rotating the web of paper relative to the paper roll. The scope of the invention shall therefore only be determined by the content of the enclosed patent claims.

What is claimed is:

1. A holder for a web of paper roll with axial dispensing of the paper from the roll, said holder comprising:

a housing which has an end wall provided with a dispensing opening;

means for rotating the web of paper being drawn from a paper roll, which is disposed in the housing, relative to the paper roll in dependence of the length of paper web being drawn out of the dispensing opening; said means being disposed within the housing, and comprising a pair of elongate, rotatable rollers disposed so that a nip between said rollers can frictionally hold a paper web drawn from a paper roll disposed in the housing, the length of paper web being drawn out of the dispensing opening determining the amount of rotation of said rollers.

2. The holder according to claim 1, wherein the means for rotating the web of paper being drawn from a paper roll, which is disposed in the housing, relative to the paper roll comprises a device for rotating the paper roll, said device having drive means driven by one of the rollers holding a paper web being drawn out of the dispensing opening.

3. The holder according to claim 2, wherein the means for rotating the web of paper being drawn from a paper roll, which is disposed in the housing, relative to the paper roll comprises a device for sensing the change in thickness of a paper roll disposed in the housing due to a length of a web of paper being drawn out of the dispensing opening and means for varying the rotational speed of the paper web relative to the paper roll in dependence of the change in thickness of the paper roll.

4. The holder according to claim 3, wherein the means for varying the rotational speed of the paper roll comprises an axially movable conical wheel being driven by a drive wheel axially extending from one of the rollers.

5. The holder according to claim 4, wherein the axially movable conical wheel is affixed to one end of a shaft being rotatably supported in the housing and extending in a direction parallel to the axis of a paper roll disposed in the housing, the other end of the shaft being connected to a device for axially moving the conical wheel in dependence of the thickness of the paper roll, and a drive means for rotating a paper roll disposed in the housing is attached to the shaft between the ends thereof.

6. The holder according to claim 5, wherein the drive means for rotating a paper roll disposed in the housing comprises a drive roller acting on the peripherical surface of the paper roll.

7. The holder according to claim 5, further comprising an annular disc rotatably supported in the housing for supporting a paper roll, and wherein the drive means for rotating a paper roll disposed in the housing comprises a drive wheel acting on the peripherical surface of the annular disc supporting the paper roll.

8. The holder according to claim 1, wherein the holder includes an annular disc for supporting a paper roll, said disc being rotatably supported in the housing.

9. The holder according to claim 1, wherein the drive means for rotating a paper roll disposed in the housing comprises an electric motor controlled by a computer to which a signal representative of the rotation of the rollers is fed.

10. The holder according to claim 1, wherein the means for rotating the web of paper being drawn from a paper roll, which is disposed in the housing, relative to the paper roll comprises a device for sensing the change in thickness of a paper roll disposed in the housing due to a length of a web of paper being drawn out of the dispensing opening and means for varying the rotational speed of the paper web relative to the paper roll in dependence of the change in thickness of the paper roll.

11. The holder according to claim 10, wherein the means for varying the rotational speed of the paper roll comprises an axially movable conical wheel being driven by a drive wheel axially extending from one of the rollers.

* * * * *